United States Patent [19]

Bain et al.

[11] 4,349,117

[45] Sep. 14, 1982

[54] TRANSPORT AND STORAGE BINS

[75] Inventors: Kenneth J. D. Bain, Rondebosch; Dennis E. King, Goodwood; Lesley A. Worship, Stellenbosch; Achmat T. Burton, Athlone, all of South Africa

[73] Assignee: Marsden (Proprietary) Limited, Cape Town, South Africa

[21] Appl. No.: 190,878

[22] Filed: Sep. 25, 1980

[51] Int. Cl.[3] ..... B65D 6/24; B65D 6/26

[52] U.S. Cl. ..... 220/4 F; 220/4 R; 220/1.5; 220/73; 220/84

[58] Field of Search ..... 220/4 R, 4 F, 1.5, 73, 220/84

[56] References Cited

U.S. PATENT DOCUMENTS

| | | | |
|---|---|---|---|
| 1,111,054 | 9/1914 | Bonneville | 220/4 F |
| 1,409,336 | 3/1922 | Fahlman | 220/73 |
| 1,934,220 | 11/1933 | Willson | 220/73 |
| 2,122,105 | 6/1938 | Mauser | 220/73 |
| 2,139,618 | 12/1938 | Hall | 220/4 R |
| 2,227,702 | 1/1941 | Castleberry | 220/19 |
| 2,815,880 | 12/1970 | Blatz | 220/4 F |
| 3,186,584 | 5/1965 | Helms | 220/73 |
| 3,499,694 | 3/1970 | Coppel | 220/1.5 |
| 3,712,504 | 1/1973 | Petersen | 220/84 |
| 4,141,459 | 2/1979 | Eli | 220/73 |

*Primary Examiner*—George E. Lowrance

*Attorney, Agent, or Firm*—Stevens, Davis, Miller & Mosher

[57] ABSTRACT

A bin for transporting and storing agricultural produce and industrial products. The bin comprises a metal base frame, four metal posts, and a metal top frame. The top frame is constituted by components forming downwardly open channels which receive the upper ends of vertical slats. The top frame can be taken apart to release the top ends of the slats. The frame can have inwardly directed teeth onto which the slats are impaled, or the slats can have slots or holes into which the teeth fit. Crossed straps join the posts to prevent outward bulging of the slats when the bin is filled. The floor can also be constituted by slats.

7 Claims, 5 Drawing Figures

TRANSPORT AND STORAGE BINS

This invention relates to transport and storage bins.

Bins are used in both agriculture and industry for transporting and storing products such as fruit, vegetables and manufactured components. The size of the bins means that they are invariably moved about by means of forklift trucks. When the driver approaches a stack of bins to lift the top bin off, it is sometimes difficult, particularly if there is overhead lighting shining in his face, for him to judge accurately where the tips of his forks are in relation to the base of the bin. An inaccurate approach can result in a bin being damaged, the forks either breaking in the sides or penetrating the base. Consequently, it is important that bin repair be as easy as possible.

In one known bin there is a vertical angle iron at each corner and the ends of the horizontal slats are secured between the angle irons and wooden corner posts of triangular cross-section. If a slat is damaged, two of the wooden posts must be removed to permit a new slat to be inserted. As each slat is secured by screws to the vertical posts, repair of a single slat involves a considerable amount of work. After the bin has been repaired there is a chance that the replaced screws may no longer be as secure as previously.

In other known bins the slats run vertically and there is a rectangular top frame consisting of four downwardly open channels. Channels of different cross-section have been used. The upper ends of the slats are received in the channels. Use of this bin has shown that unless the channels are of considerable depth the slats are not satisfactorily retained in place. If the channels are deep enough properly to retain the slats then it is difficult to lean the slats over side-ways far enough to disengage their upper edges from the channel for removal.

The present invention seeks to provide an improved bin where slat replacement is easy and which is less liable to damage by a forklift than are the types of bin described above.

According to the present invention there is provided a transport and storage bin each side of which comprises an upper metal structure, a lower metal structure and a plurality of slats, the upper structure being in the form of a downwardly open channel for receiving the upper ends of said slats which form the sides of the bin, the upper structure including two parts which are separable to free the upper ends of the slats, there being means for holding the lower ends of the slats in place relative to the lower metal structure.

Preferably the upper and lower structure are provided with teeth directed inwardly of the bin on which said slats are impaled. Alternatively, the slats can have slots therein at the upper and lower ends thereof for receiving said teeth, the slots opening through the upper and lower ends of the slats.

In one form, the upper structure includes a downwardly extending flange on the inside of the bin, said flange being inclined with respect to the vertical with its lower edge abutting the inner faces of the slats. More specifically, said upper structure can comprise an angle member having one vertical flange and one horizontal flange, and a capping element which includes a horizontal flange and a downwardly extending flange at least part of which slopes towards the vertical flange of the angle member to define therebetween a downwardly open slot for receiving the upper ends of the slats, there being means for securing the two horizontal flanges together.

The bin can further have four metal posts, there being four pairs of crossed straps secured to said posts, extending therebetween and serving to resist outward bulging of the slats when the bin is filled.

Two inverted channels can extend across the bin and have their ends secured to said lower metal structures, said channels serving to receive the forks of a forklift truck. Additionally there can be two wooden runners each extending between an associated pair of end posts, the runners being parallel to said channels.

For a better understanding of the present invention, and to show how the same may be carried into effect, reference will now be made, by way of example, to the accompanying drawings in which.

Figure 1:
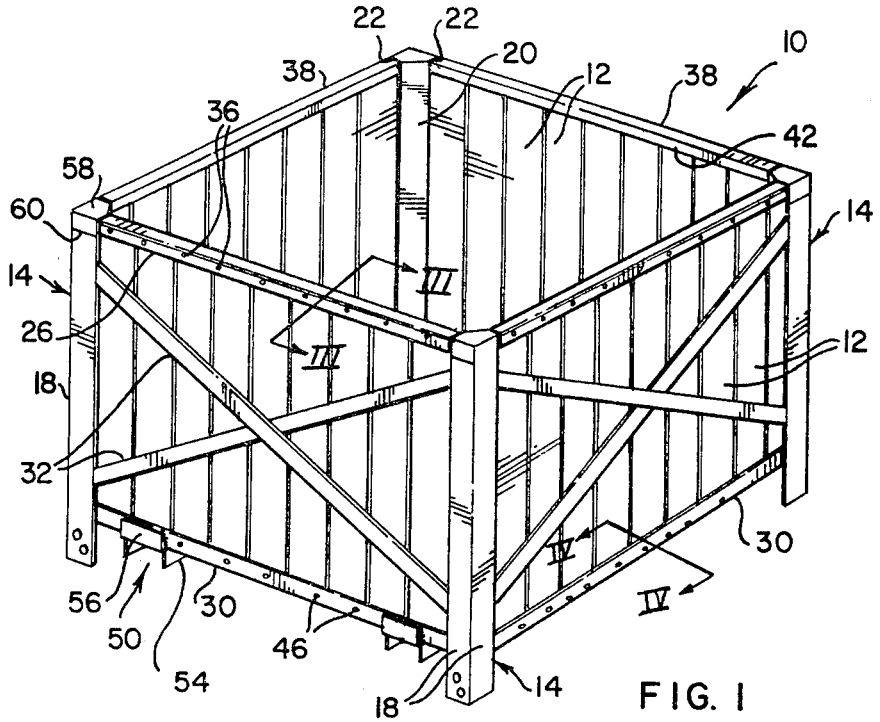
FIG. 1 is a pictorial view of a bin.
Figure 3:
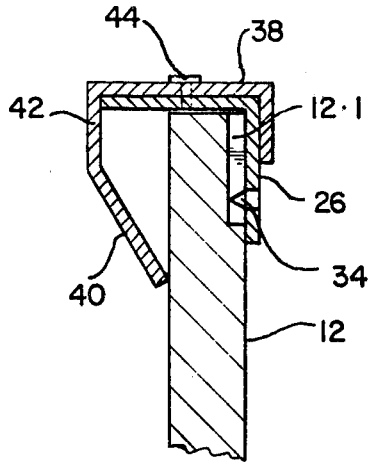
FIG. 3 is a partial section on the line III—III of FIG. 1.
Figure 4:
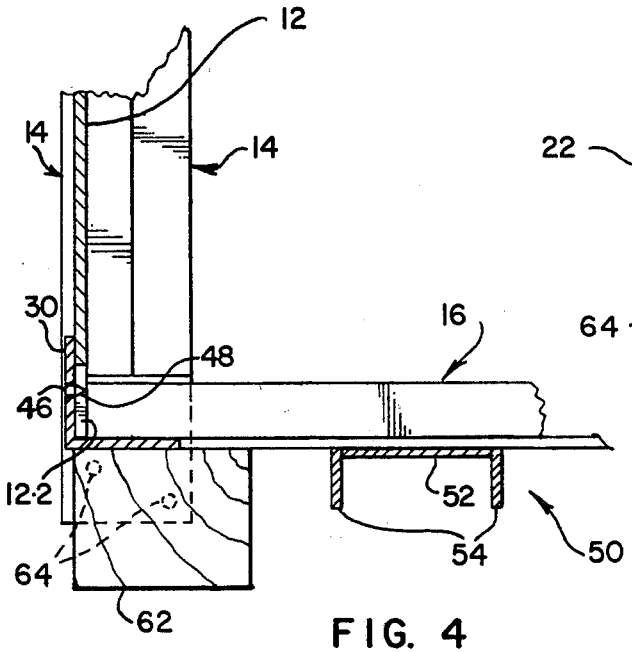
FIG. 4 is a partial section on the line IV—IV of FIG. 1.

The bin 10 illustrated in FIG. 1 is rectangular in plan and in both elevations. Each of its four side walls is composed of a plurality of vertical slats 12, the bin further including four corner posts 14 and a floor 16 (FIG. 4). The floor 16 is inself preferably composed of horizontal slats but can be of a single piece of material. Each slat is formed with a slot 12.1 (FIG. 3) and a further slot 12.2 (FIG. 4). The slot 12.1 extends downwardly from the upper edge thereof and the slot 12.2 extends upwardly from the lower edge.

Figure 5:
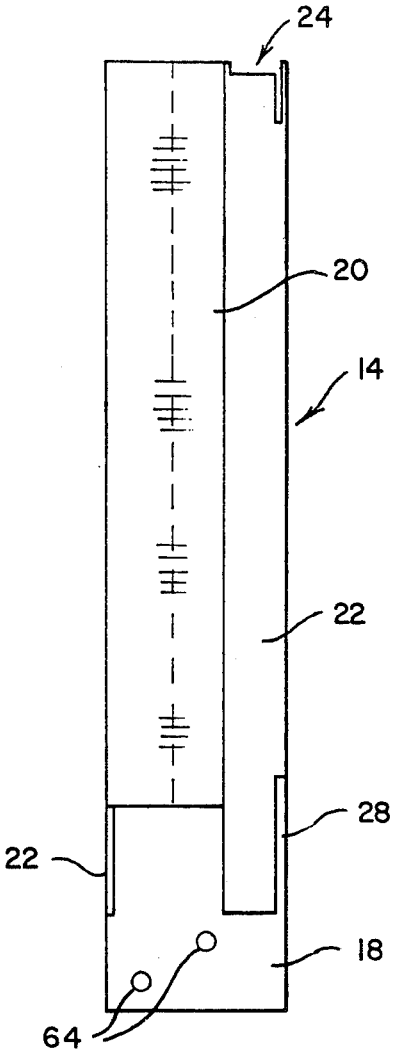
FIG. 5 is an elevation of a corner post.

Each corner post 14 (see particularly FIGS. 1 and 5) is constructed from formed sheet metal and is substantially triangular in plan view. Each corner post has two outer faces 18 which are at right angles to one another, an oblique face 20 and two smaller faces 22. A slot 24 (see particularly FIG. 5) is formed at the upper end of each face 22, each of these slots serving to receive one end of an angle member 26 (FIGS. 1 and 3). At the lower end of each post 14 the faces 18 extend beyond the faces 22 which in turn extend beyond the face 20. Two vertical slots 28 are cut in each corner post 14, these slots being located where the faces 18 and 22 join. Four angle members 30 (FIGS. 1, 2 and 4) extend between the corner posts, the vertical limbs of the members 30 being entered in the slots 28. The ends of the members 30 are welded to the corner posts 14.

Pairs of crossed, metal, strengthening straps 32 are welded to the faces 22 of the posts 14. The straps 32 resist any tendency of the slats to bulge outwardly when the bin is filled.

The vertical flange of each of the four angle members 26 is punched to form a series of teeth 34 (see FIG. 3), the teeth 34 being side-by-side in the direction of elongation of the member 26. In FIG. 1 only the holes 36 punched in the vertical flanges to form the teeth can be seen. These teeth could, if desired, be punched in the horizontal portion of the member 26 and extend downwardly therefrom.

An elongate capping element 38 surmounts each member 26, the elements 38 having the inverted channel-shape shown in FIG. 3. It will be noted that the lower portion 40 of the inner vertical flange 42 is turned inwardly to lie against the slats 12. Each associated member 26 and element 38 are suitably secured to one another, for example, by self tapping screws one of which is shown at 44 in FIG. 3. If desired the entire flange 42 can slope inwardly. If slats 12 thinner than those shown are employed then the portion 40 can be longer than illustrated.

The vertical limbs of the members 30 are punched in the same manner as the members 26 to form a further series of teeth. The punched holes are shown at 46 in FIGS. 1, 2 and 4 and one of the teeth is shown at 48 in FIG. 4. The further series of teeth could be punched in the longitudinal limbs of the members 30 and extend upwardly therefrom.

Two fork guides 50 of inverted channel shape (see FIGS. 1, 2 and 4) extend transversely of the bin beneath the floor 16. Each guide 50 comprises a web 52 and two flanges 54 extending downwardly from the web. At each end of the web 52 there is a tongue 56 which protrudes upwardly. Each tongue 56 lies adjacent the outer face of the vertical flange of one of the members 30, the tongue 56 and adjacent flange being secured to one another by rivetting, spot welding or in any other suitable way. The tongues 56 can be omitted and the guides 50 simply welded to the underside of the members 30.

To enable the illustrated bin to have another bin of the same type stacked on it, a cap 58 is welded or rivetted to the upper end of each corner post 14. These caps close the upper ends of the corner posts. Each cap has a horizontal portion which is of the same shape as the cross section of the post 14. A rectangular portion 60 extends downwardly from each horizontal portion and lies against one of the outer faces 18.

Two timber runners 62 (FIG. 4) are secured to the lower ends of the posts 14 and extend parallel to the guides 50. The runners 62 are not shown in FIGS. 1 and 2 but the holes which receive the screws which secure the runners to the posts are shown at 64. When the bins are stacked the runners 62 rest on the caps 58.

If it is desired that the fork lift be able to approach the bin from any one of the sides, two further guides 50 are provided which extend at right angles to the illustrated guides 50. It will be understood, of course, that if the guides 50 are at the same level then the flanges 54 must be cut away where the guides 50 intersect below the floor. Alternatively, the guides of one set can pass below the guides of the other set. With the arrangements, the runners 62 cannot be provided as they would interfere with entry of the fork lift truck from two of the sides. In these forms, therefore, wood blocks are attached to the lower ends of the posts 14, these blocks resting on the caps 58 of a lower bin.

The configuration of the portion 40 of capping element 38 prevents fruit being damaged by contact with the lower edge of the portion 40. For the same purpose, the ends of the portion 40 are bent over towards the vertical flange of the member 26 to prevent there being an exposed edge.

Figure 2:
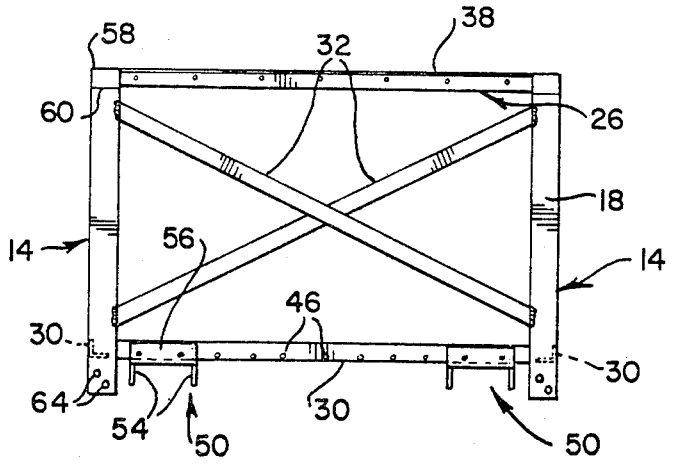
FIG. 2 is an elevation of the framework of the bin of FIG. 1.

The framework shown in FIG. 2 is initially assembled without the addition of the capping elements 38. The slats 12 are then positioned vertically and the capping elements 38 placed to trap the upper edges of the slats between the portions 40 and the members 26. The screws 44 are driven in to secure the elements to the members 26. The slots 12.1 receive the teeth 34 and the slots 12.2 receive the teeth 48. The slats forming the floor 16 are then dropped into place and nailed down, these running transversely to the guides 50 so that they are supported at their ends by the horizontal flanges of the members 30 and at two intermediate regions by the guides 50. It will be seen from FIG. 4 that the lower edges of the slats 12 are held in place by the floor slats.

The slats 12 described above are preferably of a strong yet flexible material such as a manufactured board. With this type of material removal of a damaged slat can be achieved simply by bending the slat to draw its upper end downwardly so that it is disengaged from the downwardly open channel constituted by the member 26 and element 38. Likewise the lower end of the slat leaves the gap between the floor 16 and the member 30. The teeth 34 and 48, in this form, simply prevent lateral displacement of the slats. The new slat is bowed and its ends inserted between the member 26 and element 38 and between the floor 16 and angle member 30.

The slots 12.1 and 12.2 are only required if the slats are of a relatively hard material such as a manufactured board which would resist entry of the teeth 34 and 48. If the slats are of softer material, and thus thicker, then they can simply be impaled on the teeth and can be used to hold the floor in place. Thus the floor member or floor slats is or are placed in situ first and then the slats 12 positioned to hold down the edges of the floor slats or floor member.

To replace a slat in this form, the screws 44 are removed and the element 38 lifted off to free the upper end of the damaged slat. The slat is then pulled off the teeth on which it is impaled and a new slat inserted. The element 38 is then replaced and the screws 44 reinserted.

If damaged slats are replaced by slats of a different thickness to that illustrated, then these can be accommodated by straightening the flange 42 somewhat (to use thicker slats) or bending it somewhat more if thinner slats are used. In both cases, the lower edges of the flanges 42 are brought into contact with the slats 12.

Because the guides 50 support the floor 16, this enables the gauge of the material used for the floor to be reduced with respect to that which would otherwise be necessary.

If desired the teeth 34 and 48 can be omitted and screws used to secure the upper and lower ends of the slats in place.

We claim:

1. An upwardly open, four sided transport and storage bin which comprises an upper metal structure in the form of a four sided frame, a lower metal structure in the form of a four sided frame corner posts joining the upper and lower metal structures, a plurality of slats, each slat having a first face which is directed inwardly of the bin and a second face which is directed outwardly of the bin, each side of the upper metal structure comprising a first part and a second part which together form a downwardly open channel for receiving the upper ends of the slats, said parts being separable to release the upper ends of the slats, the first part including a flange which extends downwardly adjacent said second faces of the slats and a second part including a flange which extends downwardly adjacent the first faces of the slats, the last mentioned flange sloping outwardly of the bin in the downward direction whereby its upper edge is spaced from said slats and its lower edge abuts said first faces of the slats.

2. A bin according to claim 1, in which said upper structure and said lower structure are provided with teeth directed inwardly of the bin and on which teeth said slats are impaled.

3. A bin according to claim 1, in which said upper structure and said lower structure are provided with teeth directed inwardly of the bin, said slats having slots therein at the upper and lower ends thereof for receiving said teeth, the slots opening through the upper and lower ends of the slats.

4. A bin according to claim 1, in which said first part is in the form of an angle member having one vertical flange and one horizontal flange, and said second part is in the form of a capping element which includes a horizontal flange and a downwardly extending flange at least part of which slopes towards the vertical flange of the angle member to define threbetween a downwardly open slot for receiving the upper ends of hte slats, there being means for securing the two horizontal flanges together.

5. A bin accoridng to claim 1, 2 or 3, and comprising four metal posts, there being four pairs of crossed straps secured to said posts, extending therebetween and serving to resist outward bulging of the slats when the bin is filled.

6. A bin according to claim 1, in which two inverted channels extend across the bin and have their ends secured to said lower metal structures, said channels serving to receive the forks of a forklift truck.

7. A bin according to claim 6 and including two wooden runners each extending between an associated pair of end posts, the runners being parallel to said channels.

* * * * *